US008924206B2

(12) United States Patent
Sun et al.

(10) Patent No.: US 8,924,206 B2
(45) Date of Patent: Dec. 30, 2014

(54) ELECTRICAL APPARATUS AND VOICE SIGNALS RECEIVING METHOD THEREOF

(75) Inventors: Ting-Wei Sun, Taoyuan County (TW); Hann-Shi Tong, Taoyuan County (TW)

(73) Assignee: HTC Corporation, Taoyuan County (TW)

( * ) Notice: Subject to any disclaimer, the term of this patent is extended or adjusted under 35 U.S.C. 154(b) by 552 days.

(21) Appl. No.: 13/288,970

(22) Filed: Nov. 4, 2011

(65) Prior Publication Data

US 2013/0117017 A1 May 9, 2013

(51) Int. Cl.
*G10L 21/02* (2013.01)
*G10L 21/0272* (2013.01)
*G10L 21/0216* (2013.01)

(52) U.S. Cl.
CPC ... *G10L 21/0272* (2013.01); *G10L 2021/02161* (2013.01)
USPC ..... 704/227; 704/228; 704/226; 704/233

(58) Field of Classification Search
CPC ..... G10L 21/0209; G10L 2021/02165; G10L 25/78; G10L 19/0019; G10L 19/012; G10L 19/0204; G10L 19/04; G10L 2021/02161; G10L 2021/02168; G10L 2025/783; G10L 2025/786; G10L 21/0272; G10L 25/09; G10L 25/21; G10L 25/93; H04L 29/06027; H04L 29/06; H04L 29/12018; H04L 21/12216; H04L 65/4038; H04L 65/607; H04M 3/56; H04M 3/568; H04M 9/082; H04M 3/569; H04Q 11/0478
USPC ..... 381/71.1, 92, 74, 86, 94.5; 704/226, 704/200.1, 201, 205, 213, 233, 227, 228; 370/352, 401, 356, 394, 466, 523; 379/202.01, 406.01, 406.04, 406.08; 455/570
See application file for complete search history.

(56) References Cited

U.S. PATENT DOCUMENTS 4,941,187 A * 7/1990 Slater ..... 381/86
5,758,256 A * 5/1998 Berry et al. ..... 455/72
6,018,525 A * 1/2000 Sucharczuk ..... 370/394
(Continued)

FOREIGN PATENT DOCUMENTS

CN 101192411 6/2008
CN 101278337 10/2008
(Continued)

OTHER PUBLICATIONS

"Office Action of DE Counterpart Application", issued on Feb. 18, 2013, p. 1-p. 12.
(Continued)

*Primary Examiner* — Vijay B Chawan
(74) *Attorney, Agent, or Firm* — Jianq Chyun IP Office

(57) ABSTRACT

An electrical apparatus a voice signal receiving method thereof are disclosed. The electrical apparatus includes a plurality of voice receivers, a voice activity detector, a voice channel switch and a noise eliminator. The voice receivers are used to receive the voice signals. The voice activity detector receives and detects the voice signals, and obtains a main voice signal from the voice signals. The voice channel switch transports the main voice signal to a voice transporting channel and transports a plurality of other voice signals of the voice signals other than the main voice signal to a noise transporting channel according to a detecting result of the voice activity detector. The noise eliminator reduces the noise in the main voice according to the voice signals from the noise transporting channel.

13 Claims, 3 Drawing Sheets

(56) References Cited

U.S. PATENT DOCUMENTS

| | | | | |
|---|---|---|---|---|
| 6,154,721 | A * | 11/2000 | Sonnic | 704/233 |
| 6,990,194 | B2 * | 1/2006 | Mikesell et al. | 379/406.04 |
| 7,158,933 | B2 * | 1/2007 | Balan et al. | 704/226 |
| 2002/0054589 | A1 * | 5/2002 | Ethridge et al. | 370/352 |
| 2002/0181686 | A1 * | 12/2002 | Howard et al. | 379/202.01 |
| 2004/0234069 | A1 * | 11/2004 | Mikesell et al. | 379/406.01 |
| 2007/0021958 | A1 * | 1/2007 | Visser et al. | 704/226 |
| 2009/0248402 | A1 * | 10/2009 | Ito et al. | 704/201 |
| 2011/0026722 | A1 * | 2/2011 | Jing et al. | 381/71.1 |
| 2011/0286605 | A1 * | 11/2011 | Furuta et al. | 381/71.1 |

FOREIGN PATENT DOCUMENTS

| | | |
|---|---|---|
| CN | 101502089 | 8/2009 |
| CN | 101513030 | 8/2009 |
| WO | 2008011902 | 1/2008 |

OTHER PUBLICATIONS

"Office Action of China Counterpart Application", issued on Jul. 15, 2014, p. 1-p. 6.

* cited by examiner

ELECTRICAL APPARATUS AND VOICE SIGNALS RECEIVING METHOD THEREOF

TECHNICAL FIELD

The disclosure relates to an electrical apparatus used for receiving voice signals. Particularly, the disclosure relates to a communication device having an electrical apparatus capable of receiving voice signals.

BACKGROUND

Referring to FIG. 1, FIG. 1 is a schematic diagram of a conventional voice receiving device 100. The conventional voice receiving device 100 includes two microphones 111 and 112, a voice activity detector (VAD) 120 and a noise eliminator 130.

In the conventional voice receiving device 100, the microphone 111 is set to receive main voices, and the microphone 112 is set to receive non-main voices. The microphones 111 and 112 are respectively coupled to the VAD 120 and the noise eliminator 130. The VAD 120 receives voices through the microphones 111 and 112, and transports the voices received from the microphone 111 to the noise eliminator 130 through a voice transporting channel MT in form of voice signals. Meanwhile, the VAD 120 transports voice signals provided by the microphone 112 to the noise eliminator 130 through a noise transporting channel NT. The noise eliminator 130 eliminates noises of the voice signals transported by the voice transporting channel MT according to the voice signals transported by the noise transporting channel NT, so as to obtain clear voice signals.

However, in an actual application, the microphone 111 may not be able to receive the main voice signal. In a multi-people conference, the microphone used to receive the main voice signals is dynamically changed. Therefore, when the conventional voice receiving device 100 is used, a user has to adjust a position of the main microphone 111 from time to time in order to obtain clear voice signals, which inconvenient in utilization.

SUMMARY

The disclosure is directed to an electrical apparatus, which adaptively detects a main voice signal and non-main voice signals in a plurality of voice signals, so as to effectively reduce noises of the voice signals.

The disclosure is directed to another electrical apparatus, which adaptively detects a main voice signal and non-main voice signals in a plurality of voice signals, so as to effectively reduce noises of the voice signals.

The disclosure provides an electrical apparatus including a plurality of voice receivers, a voice activity detector, a voice channel switch and a noise eliminator. The voice receivers are used to receive a plurality of voices, and convert the voices into voice signals. The voice activity detector is coupled to the voice receivers, and receives and detects the voice signals, and obtains a main voice signal from the voice signals. The voice channel switch is coupled to the voice receives and the voice activity detector, and transports the main voice signal to a voice transporting channel and transports a plurality of other voice signals of the voice signals other than the main voice signal to a noise transporting channel according to a detecting result of the voice activity detector. The noise eliminator is coupled to the voice transporting channel and the noise transporting channel, and reduces noise of the main voice signal in the voice transporting channel according to the other voice signals of the noise transporting channel.

In an embodiment of the disclosure, the voice activity detector determines whether each of the voice signals is the main voice signal according to a characteristic function the voice signal.

In an embodiment of the disclosure, the voice activity detector sets a plurality of identification numbers for the voice signals, and generates an indication signal according to the identification number of the main voice signal.

In an embodiment of the disclosure, the voice channel switch receives the indication signal, and transports the main voice signal with the identification number equal to the indication signal to the voice transporting channel, transport the voice signals with the identification numbers unequal to the indication signal to the noise-transporting channel.

In an embodiment of the disclosure, the noise eliminator is a processor, and the processor executes a noise-eliminating algorithm to reduce the noise of the main voice signal in the voice-transporting channel according to the other voice signals of the noise-transporting channel.

The disclosure provides an electrical apparatus including a voice-receiving device. The voice receiving device has a plurality of voice receivers for receiving a plurality of voices and converting the voices into a plurality of voice signals. The voice receiving device includes a voice activity detector, a voice channel switch and a noise eliminator. The voice activity detector is coupled to the voice receivers, and receives and detects the voice signals, and obtains a main voice signal from the voice signals. The voice channel switch is coupled to the voice receives and the voice activity detector, and transports the main voice signal to a voice transporting channel and transports a plurality of other voice signals of the voice signals other than the main voice signal to a noise transporting channel according to a detecting result of the voice activity detector. The noise eliminator is coupled to the voice transporting channel and the noise transporting channel, and reduces noise of the main voice signal in the voice transporting channel according to the other voice signals of the noise transporting channel.

The disclosure further provides a method for processing voices, which includes following steps: receiving a plurality of voices, and converting the voices to voice signals; detecting the voice signals for obtaining a main voice signal of the voice signals; moreover, transporting the main voice signal to a voice transporting channel, and transporting a plurality of other voice signals of the voice signals other than the main voice signal to a noise transporting channel; furthermore, reducing a noise of the main voice signal in the voice transporting channel according to the other voice signals from the noise transporting channel.

According to the above descriptions, the main voice signal is obtained by dynamically detecting a plurality of voice signals. Noise reduction is performed according to the main voice signal and the other non-main voice signal, so as to obtain the voice signal with high quality and low noise.

In order to make the aforementioned and other features and advantages of the disclosure comprehensible, several exemplary embodiments accompanied with figures are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DETAILED DESCRIPTION OF DISCLOSED EMBODIMENTS

Figure 1:
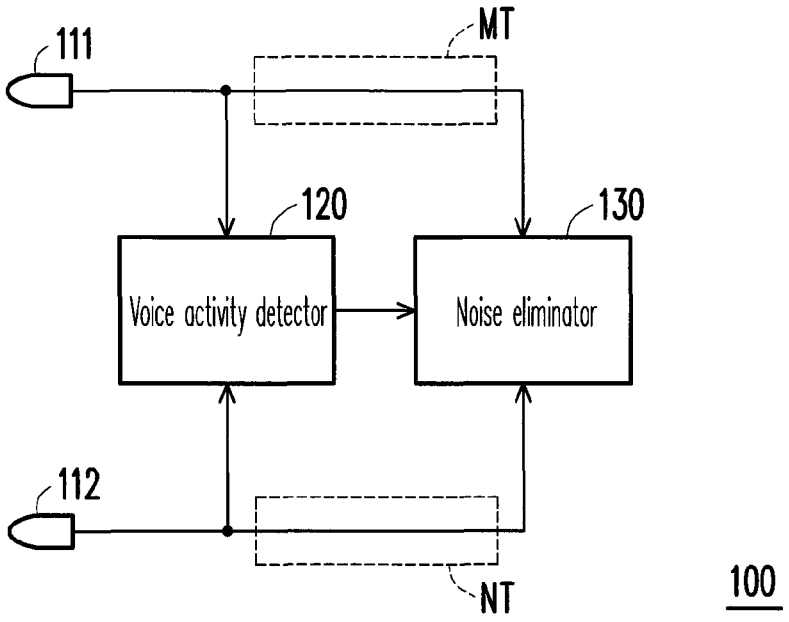
FIG. 1 (RELATED ART)
FIG. 1 is a schematic diagram of a conventional voice receiving device 100.
Figure 2:
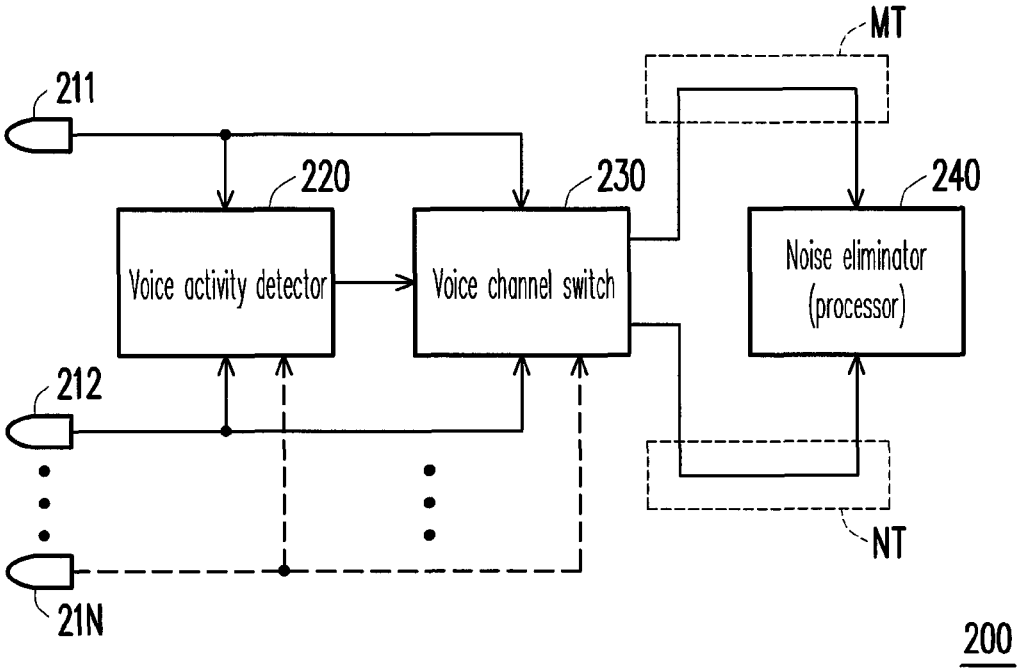
FIG. 2 is a schematic diagram of an electrical apparatus 200 according to an embodiment of the disclosure.

Referring to FIG. 2, FIG. 2 is a schematic diagram of an electrical apparatus 200 according to an embodiment of the disclosure. The electrical apparatus 200 includes a plurality of voice receivers 211-21N, a voice activity detector 220, a voice channel switch 230 and a noise eliminator 240. The voice receivers 211-21N are disposed on a voice receiving device 200, and are used to receive a plurality of voices from different directions and convert the received voices into voice signals.

The voice activity detector 220 is coupled to the voice receivers 211-21N, and receives the voice signals transmitted by the voice receivers 211-21N. Moreover, the voice activity detector 220 further detects the voice signals to obtain a main voice signal from the voice signals transmitted by the voice receivers 211-21N.

Figure 3:
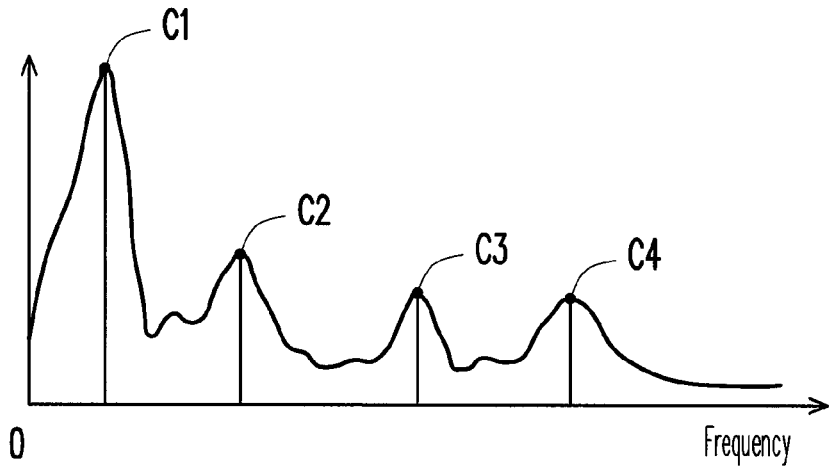
FIG. 3 illustrates a voice spectrum diagram.

Referring to FIG. 2 and FIG. 3, where FIG. 3 illustrates a voice spectrum diagram. The voice activity detector 220 receives a plurality of the voice signals provided by the voice receivers 211-21N, and detects a characteristic function of each of the voice signals to determine whether the voice signal is the main voice signal. Taking the spectrum diagram of FIG. 3 as an example, in a spectrum of the voice signal, different frequencies correspond to a plurality of endpoints C1-C4. The voice activity detector 220 may detect the number of the endpoints C1-C4 of each of the voice signals to learn whether each of the voice signals is closest to human voice, i.e. the main voice signal.

The voice activity detector 220 detects the voice signals according to an algorithm of voice activity detection. The algorithm of voice activity detection is also referred to as an endpoint detection method. The voice activity detector 220 may perform the detections according to the characteristic functions (for example, the endpoints of in the spectrum) of the voice signals, and the commonly used algorithms of voice activity detection include low-frequency spectral magnitude (LFSM), full-band spectral magnitude (FBSM), cumulative quantized spectrum (CQS) and high-pass log-energy (HPLE), etc.

It should be noticed that the voice activity detector 220 may set identification numbers for the received voice signals, for example, set identification numbers 1-N for the voice signals received from the voice receivers 211-21N. If the voice activity detector 220 detects that the voice signal received from the voice receiver 215 is the main voice signal, the voice activity detector 220 generates an indication signal according to the identification number 5 of the voice signal received from the voice receiver 215. In brief, the indication signal may be a digital format code of 5, i.e. "0101".

Referring to FIG. 2, the voice channel switch 230 is coupled to the voice receives 211-21N and the voice activity detector 220. The voice channel switch 230 transports the main voice signal of the voice signals provided by the voice receivers 211-21N to a voice transporting channel MT according to a detecting result of the voice activity detector 220. Moreover, the voice channel switch 230 further transports a plurality of other voice signals of the voice signals provided by the voice receivers 211-21N other than the main voice signal to a noise transporting channel NT. According to the above example of the voice activity detector 220, when the voice channel switch 230 receives the indication signal "0101" transmitted by the voice activity detector 220, the voice channel switch 230 learns that the voice signal with the identification number of 5 is the main voice signal. Therefore, the voice channel switch 230 transports the voice signal with the identification number equal to 5 to the voice transporting channel MT, and transports the voice signals with the identification numbers unequal to 5 to the noise transporting channel NT.

The noise eliminator 240 is coupled to the voice transporting channel MT and the noise transporting channel NT, and receives the main voice signal and the non-main voice signals through the voice transporting channel MT and the noise transporting channel NT. It should be noticed that in recognition of the voice signals, a plurality of factors might influence a voice recognition result, wherein, main factors are additive noises and convolutional noises in the environment and bandwidth limitation of voice transportation, etc. The additive noise may also be referred to as a background noise since all sounds produced in the environment where the voice-receiving device is located are added to the voice signal, which causes recognition difficulty of the voice signals. The convolutional noise may also be referred to as a channel noise or channel distortion, which is mainly caused by difference of the voice receivers 211-21N (for example, microphones), and influence of external electromagnetic waves due to poor shielding effect of transmission lines.

Therefore, the noise eliminator 240 may establish a database of the noise information generated in the environment according to the one or a plurality of the non-main voice signals transported by the noise-transporting channel NT. The noise eliminator 240 may eliminate the noise of the main voice signal according to the database of the noise information, and may further improve the capability of reducing the noise of the main voice signal according to different usage environments and operation state and limitation of hardware.

In the present embodiment, the noise eliminator 240 may be directly implemented by a hardware circuit, or may be a processor having a computing capability that executes software program with a noise eliminating algorithm to implement noise reduction.

Figure 4:
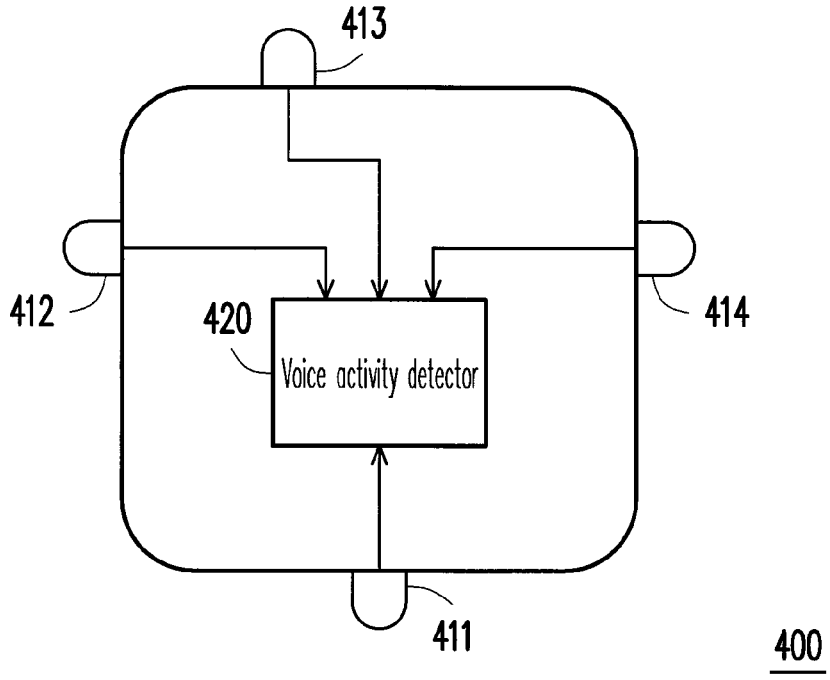
FIG. 4 is a schematic diagram of a communication device 400 according to an embodiment of the disclosure.

Referring to FIG. 4, FIG. 4 is a schematic diagram of a communication device 400 according to an embodiment of the disclosure. An electrical apparatus of the communication device 400 includes a voice receiving device 420, and the voice receiving device 420 has a plurality of voice receivers 411-414 for receiving a plurality of voices and converting the voices into a plurality of voice signals. In the present embodiment, the voice receivers 411-414 are respectively disposed at four sides of the communication device 400 for receiving voices from different directions. In brief, when a participant closed to the voice receiver 411 talks, the voice receiving device 420 determines that the voice signal provided by the voice receiver 411 is the main voice signal, and non-main voices received by the voice receivers 412-413 are probably noises in the conference environment and/or noises produced due to mutual interference of various components in the communication device 400. Therefore, the voice-receiving device 420 may take the non-main voice signals received by the voice receivers 412-413 as noise determination basis to effectively reduce the noise in the main voice signal, to improve the quality of the voice signal.

Figure 5:
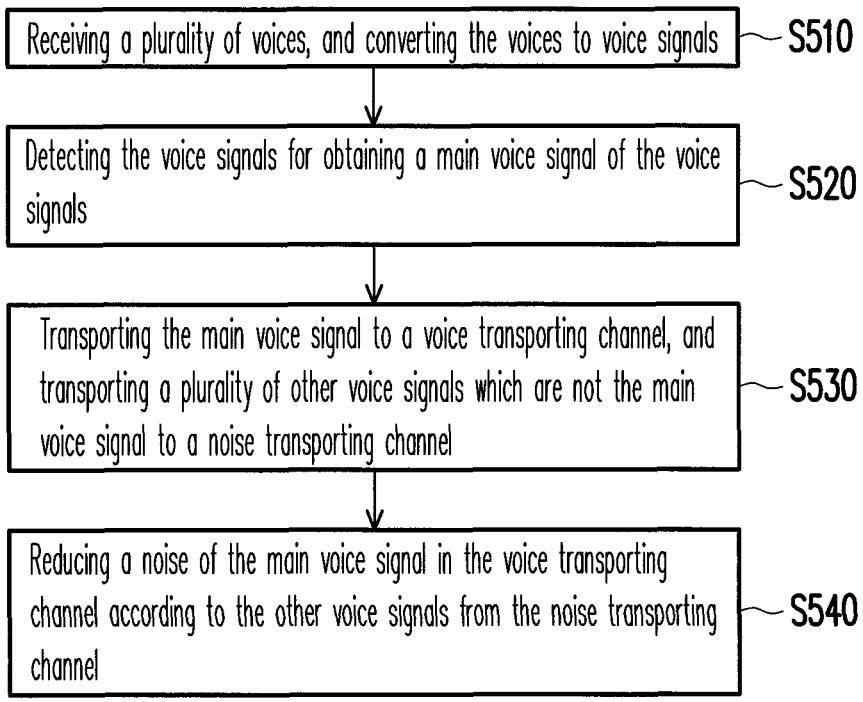
FIG. 5 is a flowchart illustrating a method for processing voices according to an embodiment of the disclosure.

Referring to FIG. 5, FIG. 5 is a flowchart illustrating a method for processing voices according to an embodiment of the disclosure. The method includes following steps: firstly, receiving a plurality of voices, and converting the voices to voice signals (S510); then, detecting the voice signals for obtaining a main voice signal of the voice signals (S520); moreover, transporting the main voice signal to a voice transporting channel, and transporting a plurality of other voice signals of the voice signals other than the main voice signal to a noise transporting channel (S530); furthermore, reducing a noise of the main voice signal in the voice transporting channel according to the other voice signals from the noise transporting channel (S540). Voice processing details of the present embodiment have been described in detail in the aforementioned embodiments, which are not repeated herein.

In summary, in the disclosure, the main voice signal and the non-main voice signals are obtained by detecting the voice signals received from a plurality of voice receivers. Then, the noise of the main voice signal is eliminated according to the non-main voice signals, so as to improve the quality of the main voice signal. Since a main voice receiver in the voice receivers is dynamically adjusted, the voice receiving device is unnecessary to be adjusted according to the position of the user, by which not only usage convenience is considered, but also the voice quality is effectively improved.

It will be apparent to those skilled in the art that various modifications and variations may be made to the structure of the disclosure without departing from the scope or spirit of the disclosure. In view of the foregoing, it is intended that the disclosure cover modifications and variations of this disclosure provided they fall within the scope of the following claims and their equivalents.

What is claimed is:

1. An electrical apparatus, comprising:

a plurality of voice receivers, receiving a plurality of voices, and converting the voices into voice signals;

a voice activity detector, coupled to the voice receivers, receiving and detecting the voice signals, for selecting one of the voice signals to obtain a main voice signal;

a voice channel switch, coupled to the voice receives and the voice activity detector, and transporting the main voice signal to a voice transporting channel and transporting a plurality of other voice signals of the voice signals other than the main voice signal to a noise transporting channel according to a detecting result of the voice activity detector; and a noise eliminator, coupled to the voice transporting channel and the noise transporting channel, and reducing a noise of the main voice signal in the voice transporting channel according to the other voice signals of the noise transporting channel.

2. The electrical apparatus as claimed in claim 1, wherein the voice activity detector determines whether each of the voice signals is the main voice signal according to a characteristic function the voice signal.

3. The electrical apparatus as claimed in claim 1, wherein the voice activity detector sets a plurality of identification numbers for the voice signals, and generates an indication signal according to the identification number of the main voice signal.

4. The electrical apparatus as claimed in claim 3, wherein the voice channel switch receives the indication signal, transports the main voice signal with the identification number equal to the indication signal to the voice transporting channel, and transports the voice signals with the identification numbers unequal to the indication signal to the noise transporting channel.

5. The electrical apparatus as claimed in claim 1, wherein the noise eliminator is a processor, and the processor executes a noise eliminating algorithm to reduce the noise of the main voice signal in the voice transporting channel according to the other voice signals of the noise transporting channel.

6. An electrical apparatus, comprising:

a communication module, having a communication function;

a voice receiving device, having a plurality of voice receivers for receiving a plurality of voices and converting the voices into a plurality of voice signals, and comprising:

a voice activity detector, coupled to the voice receivers, receiving and detecting the voice signals, for selecting one of the voice signals to obtain a main voice signal;

a voice channel switch, coupled to the voice receives and the voice activity detector, and transporting the main voice signal to a voice transporting channel and transporting a plurality of other voice signals of the voice signals other than the main voice signal to a noise transporting channel according to a detecting result of the voice activity detector; and a noise eliminator, coupled to the voice transporting channel and the noise transporting channel, and reducing a noise of the main voice signal in the voice transporting channel according to the other voice signals of the noise transporting channel, wherein the filtered main voice signal is transmitted by the communication module.

7. The electrical apparatus as claimed in claim 6, wherein the voice activity detector determines whether each of the voice signals is the main voice signal according to a characteristic function the voice signal.

8. The electrical apparatus as claimed in claim 6, wherein the voice activity detector sets a plurality of identification numbers for the voice signals, and generates an indication signal according to the identification number of the main voice signal.

9. The electrical apparatus as claimed in claim 8, wherein the voice channel switch receives the indication signal, transports the main voice signal with the identification number equal to the indication signal to the voice transporting channel, and transports the voice signals with the identification numbers unequal to the indication signal to the noise transporting channel.

10. The electrical apparatus as claimed in claim 6, wherein the noise eliminator is a processor, and the processor executes a noise eliminating algorithm to reduce the noise of the main voice signal in the voice transporting channel according to the other voice signals of the noise transporting channel.

11. A method for processing voices, comprising:

receiving a plurality of voices, and converting the voices into voice signals;

detecting the voice signals to select one of the voice signals for obtaining a main voice signal;

transporting the main voice signal to a voice transporting channel, and transporting a plurality of other voice signals of the voice signals other than the main voice signal to a noise transporting channel; and reducing noise of the main voice signal in the voice transporting channel according to the other voice signals of the noise transporting channel.

12. The method for processing voices as claimed in claim 11, wherein the step of receiving and detecting the voice signals to obtain the main voice signal from the voice signals comprises:

determining whether each of the voice signals is the main voice signal according to a characteristic function the voice signal.

13. The method for processing voices as claimed in claim 11, wherein the step of transporting the main voice signal to the voice transporting channel, and transporting the other voice signals of the voice signals other than the main voice signal to the noise transporting channel according to a detecting result of the voice activity detector comprises:

setting a plurality of identification numbers for the voice signals, and the voice activity detector generates an indication signal according to the identification number of the main voice signal; and transporting the main voice signal with the identification number equal to the indication signal to the voice transporting channel, and transporting the voice signals with the identification numbers unequal to the indication signal to the noise transporting channel.

* * * * *